US006554752B2

(12) United States Patent
Cook

(10) Patent No.: US 6,554,752 B2
(45) Date of Patent: Apr. 29, 2003

(54) WEIGHTED EXERCISE APPARATUS AND METHOD

(76) Inventor: Arnold J. Cook, 413 N. Pasadena Dr., Pittsburgh, PA (US) 15215

( * ) Notice: Subject to any disclaimer, the term of this patent is extended or adjusted under 35 U.S.C. 154(b) by 0 days.

(21) Appl. No.: 09/851,760

(22) Filed: May 9, 2001

(65) Prior Publication Data

US 2001/0019986 A1 Sep. 6, 2001

Related U.S. Application Data

(63) Continuation of application No. 09/019,477, filed on Feb. 5, 1998, now Pat. No. 6,244,997.

(51) Int. Cl.[7] ..... A63B 21/065

(52) U.S. Cl. ..... 482/105; 482/93

(58) Field of Search ..... 482/74, 93, 105–108; 2/102

(56) References Cited

U.S. PATENT DOCUMENTS

| | | | | |
|---|---|---|---|---|
| 5,002,270 A | * | 3/1991 | Shine | 482/105 |
| 5,010,596 A | * | 4/1991 | Brown et al. | 482/105 |
| 5,300,000 A | * | 4/1994 | Schwartz | 482/105 |
| 5,893,370 A | * | 4/1999 | Perez et al. | 2/94 |

* cited by examiner

*Primary Examiner*—John Mulcahy
(74) *Attorney, Agent, or Firm*—Ansel M. Schwartz

(57) ABSTRACT

Exercise weights and method, regarding belts, handweights, arm weights, ankle weights, and knuckles weights.

8 Claims, 8 Drawing Sheets

WEIGHTED EXERCISE APPARATUS AND METHOD

This application is a continuation of application Ser. No. 09/019,477 filed on Feb. 5, 1998, now U.S. Pat. No. 6,244,997.

FIELD OF THE INVENTION

The present invention is related to exercise weights. More specifically, the present invention is related to exercise weights which fit into pockets, or can be adjusted or placed in a holder whose tension can be adjusted about the body of a user.

BACKGROUND OF THE INVENTION

Exercise equipment is commonly used by the multitude of people who exercise. There is an enormous collection of exercise equipment for exercises. The present invention offers comfort, ease of use, adjustability and compactness to the exerciser to make exercising more convenient and for the exerciser to achieve the desired training for a given muscle or muscle group.

SUMMARY OF THE INVENTION

The present invention pertains to an ankle weight system. The system comprises an adjustable weighting system. The system comprises a mechanism for holding the weighting system to an ankle of the user.

The present invention pertains to a method for exercising. The method comprises the steps of zipping a first cell having a first weight to a second cell having a second weight. Then there is the step of placing the first cell and second cell around the leg. Next there is the step of pulling a strap of the first cell tight around the leg. Then there is the step of pulling a strap of the second cell tight around the leg.

The present invention pertains to a wrist weight system. The system comprises a weight portion weighing at least 15 ounces having a first end and a second end. The system comprises a stretchable band portion that connects with the first end and the second end of the weight portion and together with the weight portion forms a closed continuous essentially cylindrical shape with an opening having a diameter through which the user inserts the wrist. The system comprises an adjustable tensioning portion connected to the weight portion which varies the tension of the weight portion about the wrist.

The present invention pertains to a method for exercising. The method comprises the steps of inserting a wrist through an opening of a wrist weight having an essentially cylindrical shape. Then there is the step of pulling a tensioning portion of the wrist weight so a weighted portion of the wrist weight is tightened about the rest. Next there is the step of securing the tensioning portion to the weighted portion to maintain the tension of the weighted portion.

The present invention pertains to a belt-ankle-wrist-thigh weight system. The system comprises a first weight portion. The system comprises a first attachment portion connected to the first weight portion which is attachable to a user. The system comprises a second weight portion. The system comprises a second attachment portion connected to the second weight portion which is attachable to a user. The second attachment portion is attachable and separable with the first attachment portion to form a third continuous weight portion of the first and second weight portions which is attachable to a user.

The present invention pertains to a method for exercising. The method comprises the steps of attaching a first weight portion to a second weight portion. Then there is the step of strapping the first and second weight portions around the hips of a user so the first and second weight portions are situated over the right and left hips, respectively. Next there is the step of removing the first and second weight portions from the user. Then there is the step of separating the first and second weight portions. Next there is the step of strapping the first weight portion to the right thigh of the user. Then there is the step of strapping the second weight portion to the left thigh of the user.

The present invention pertains to an exercise apparatus. The apparatus comprises a weight. The apparatus comprises a holder for a weight. The holder has a pocket which holds the weight. The pocket has a slot through which the weight is placed into or removed from the pocket. The pocket has a smooth outer surface with no protrusions or flap or zipper extending from the surface.

The present invention pertains to a handweight. The handweight comprises a holder portion which is adapted to fit about the hand and wrist of a user. The holder portion holding a first weight about the hand and a second weight about the wrist. The first and second weight are adjustable. The handweight comprises a first weight. The handweight comprises a second weight.

The present invention pertains to a method for exercising. The method comprises the steps of placing a holder portion about the hand and wrist of a user. Then there is the step of removing a first weight from a first pocket over the hand of the holder portion. Next there is the step of removing the second weight from a second pocket over the wrist of the holder portion. Then there is the step of inserting a new first weight having a different weight than the first weight into the first pocket. Next there is the step of inserting a new second weight having a different weight then the second weight into the second pocket.

The present invention pertains to a handweight. The handweight comprises a holder portion which fits about the hand and has a plurality of pockets. Each pocket has a slot. The pockets are adapted to be disposed about the knuckles of a user. The handweight comprises a plurality of weights which are removably disposed in respective pockets. Each weight is inserted in and removed from the pocket through respective slots in the pockets.

The present invention pertains to a handweight. The handweight comprises a one piece holder portion with a pocket. The handweight comprises a one piece continuous foldable weight which is disposed in the handweight and holder portion and extends about the hand of a user when the handweight is on the hand of the user.

The present invention pertains to an exercise apparatus. The exercise apparatus comprises a vest adapted to fit about the chest and back of a user. The vest has pockets which hold weights. The exercise apparatus comprises an adjustable fitting mechanism which can tighten the vest about the user from the right and left sides of the user.

BRIEF DESCRIPTION OF THE DRAWINGS

In the accompanying drawings, the preferred embodiment of the invention and preferred methods of practicing the invention are illustrated in which:

FIGS. 29, 38, 31, 32 and 33 are schematic representations of an exercise apparatus regarding a vest of the present invention.

DETAILED DESCRIPTION

Figure 1:
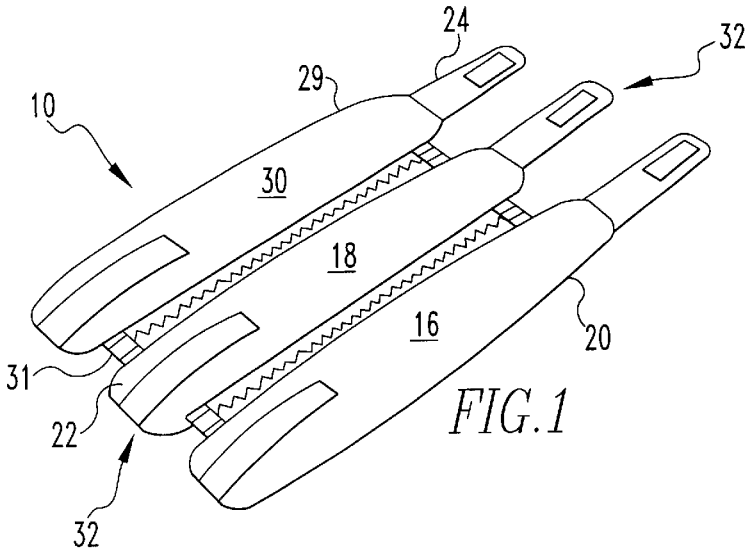
FIGS. 1, 2 and 3 are schematic representations of ankle weights of the present invention.
Figure 2:
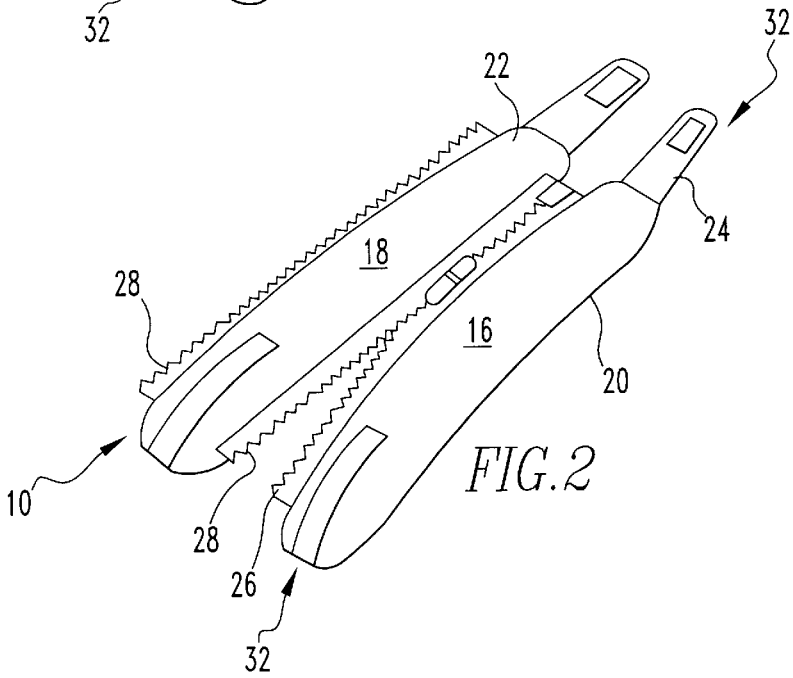
Figure 3:
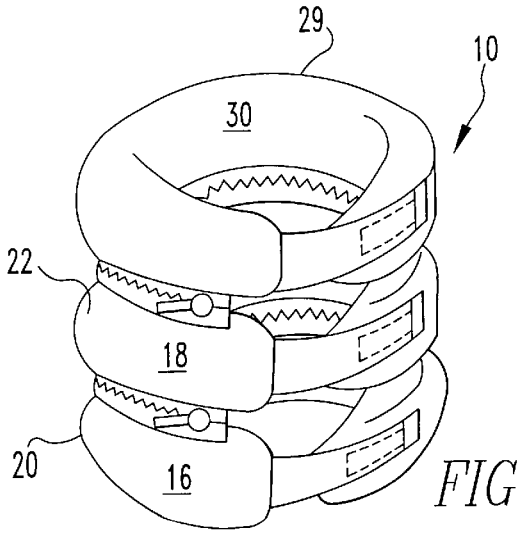

Referring now to the drawings wherein like reference numerals refer to similar or identical parts throughout the several views, and more specifically to FIGS. 1, 2 and 3 thereof, there is shown an ankle weight system 10. The ankle weight system 10 comprises an adjustable weighting system 12. The ankle weight system 10 comprises a mechanism 14 for holding the weighting system 14 to an ankle of the user.

Preferably, the weighting system 12 includes a first weight 16 of at least one pound and at least a second weight 18 of at least one pound. The holding mechanism 14 preferably includes a first cell 20 and at least a second cell 22 which is attachable and separable from the first cell 20. The first cell 20 holds the first weight 16, and the second cell 22 holds the second weight 18. Preferably, each cell has a strap 24 which is adapted to wrap around the leg of a user. The first cell 20 preferably includes a first zipper mechanism 20, and the second cell 22 includes a second zipper mechanism 28 which zips with the first zipper mechanism 26.

The present invention pertains to a method for exercising. The method comprises the steps of zipping a first cell 20 having a first weight 16 to a second cell 22 having a second weight 18. Then there is the step of placing the first cell 20 and second cell 22 around the leg. Next there is the step of pulling a strap 24 of the first cell 20 tight around the leg. Then there is the step of pulling a strap 24 of the second cell 22 tight around the leg.

In the operation of the ankle weight system 10, as shown in FIGS. 1, 2 and 3, there is a first weight 16 disposed in a first cell 20. The first cell 20 has a first zipper mechanism 26 attached to it. A second cell 22 has a second weight 18 and a second zipper mechanism 28 attached to it. The first cell 20 is connected to the second cell 22 by zipping together at the first and second zipper mechanisms. If desired, additional cells with additional weights having the zipper mechanisms attached to the perspective cells can be combined with the second cell 22 to extend the ankle weight system 10 and add weight to the ankle weight system 10. Typically the third cell 29 having a third weight 30 with a third zipper mechanism 31 is attached through the zipper mechanisms to the second cell 22, as shown in FIG. 1 and FIG. 3.

When the user wishes to use the ankle weight system 10. The user determines how much weight is to be included on the ankle weight system 10. The user then combines a desired number of cells to attain this weight. The cells, connected together through the zipper mechanisms are wrapped around an ankle and held in place by hook and loop fasteners 32 which connect opposite ends of the cells together to form a closed loop around the ankle.

The present invention pertains to a wrist weight system 40. The system 40 comprises a weight portion 41 weighing at least 15 ounces having a first end 42 and a second end 43. The system 40 comprises a stretchable band portion 44 that connects with the first end 42 and the second end 43 of the weight portion 41 and together with the weight portion 41 forms a closed continuous essentially cylindrical shape with an opening 45 having a diameter through which the user inserts the wrist. The system 40 comprises an adjustable tensioning portion 46 connected to the weight portion 41 which varies the tension of the weight portion 41 about the wrist.

Preferably, the tensioning portion 46 includes a strap 47 having a fixed strap end 48 connected to the first end 42 of the weight portion 41 and a free strap end 49. The strap 47 has a first connector portion 50 adjacent the free strap end 49. The tensioning portion 46 includes a second connector portion 51 disposed adjacent the second end 43 of the weight portion 41 which mates with the first connector portion 50 to maintain the weight portion 41 at a desired tension about the wrist of the user. The first connector portion 50 and second connector portion 52 are preferably hook and loop fasteners, respectively.

The present invention pertains to a method for exercising. The method comprises the steps of inserting a wrist through an opening 45 of a wrist weight 40 having an essentially cylindrical shape. Then there is the step of pulling a tensioning portion 46 of the wrist weight 40 so a weighted portion 41 of the wrist weight 40 is tightened about the rest. Next there is the step of securing the tensioning portion 46 to the weighted portion 41 to maintain the tension of the weighted portion 41.

Figure 4:
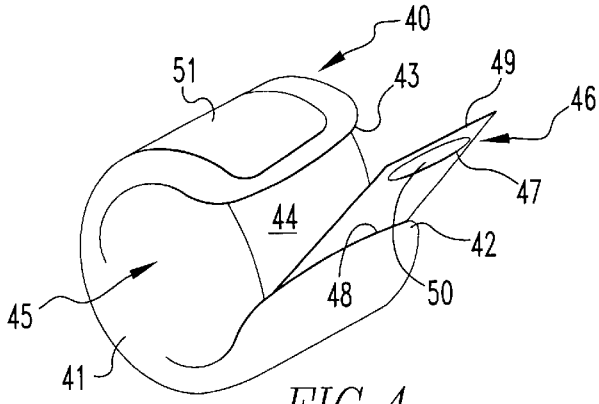
FIGS. 4, 5 and 6 are schematic representations of wrist weight of the present invention.
Figure 5:
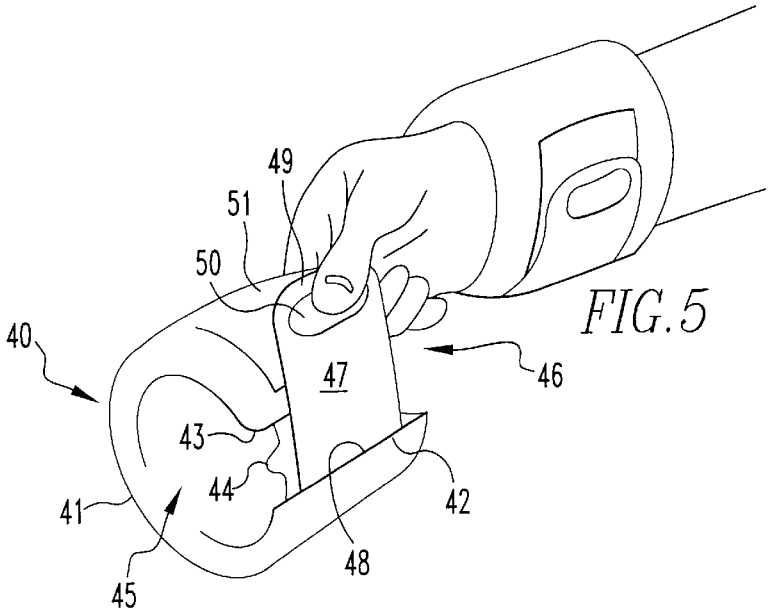

In the operation of the wrist weight system 40, the hand of a user is inserted through the opening 45 of the weight portion 41 until the wrist weight system 40 is positioned about the wrist of the user. See FIG. 5. The weight portion of 41 has a first end 42 and a second end 43 that are connected together through a band portion 44 which stretches to allow the first end 42 and second end 43 to separate from each other and still be connected to each other as a hand moves through the opening 45. The band portion 44 serves to maintain the weight portion 41 in the desired cylindrical shape to facilitate easy positioning of the wrist weight system 40 by the user. See FIG. 4.

Figure 6:
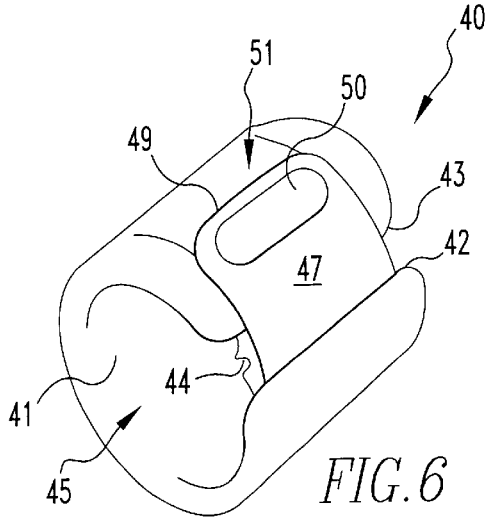

Once the wrist weight system 40 is in a desired position around the wrist of the user, a strap 47 which is attached to the first end 42 at a fixed strap end 48 is pulled to in turn pull the first end 42 toward the second end 43. This serves to tension the weight portion 41 onto the wrist. The free strap end 49 of the strap 47 is then placed down onto the weight portion 41. At the free strap end 49 is a first connection portion 50. Adjacent to the second end 43 of the weight portion 41 is a second connector portion 51. The first connector portion 50, when placed against the second connector portion 51 is held in place and maintains the weight portion 41 in a desired tension. See FIG. 6. The first connector portion 50 and second connector portion of 51 can be hook and loop fasteners.

The present invention pertains to a belt-ankle-wrist-thigh weight system 55. The system 55 comprises a first weight portion 56. The system 55 comprises a first attachment portion 57 connected to the first weight portion 56 which is attachable to a user. The system 55 comprises a second weight portion 58. The system 55 comprises a second attachment portion 59 connected to the second weight portion 58 which is attachable to a user. The second attachment portion 59 is attachable and separable with the first attachment portion 57 to form a third weight portion 60 of the first and second weight portions which is attachable to a user.

Preferably, the first weight portion 56 and the second weight portion 58 each have a plurality of weights 61 that are held by the respective attachment portion. Each attachment portion preferably has a plurality of pockets 62, each pocket holding a weight 61.

Preferably, the first attachment portion 57 includes a first strap 63 to which pockets 62 are attached. The first strap 63 has hook and loop fasteners 64 which holds the first weight portion 56 to the user. The second attachment portion 59 includes a second strap 65 to which pockets 62 are attached. The second strap 65 has hook and loop fasteners 64 which hold the second weight portion 58 to the user and to the first attachment portion 57. The first and second attachment portions preferably each have a loop 66 through which a strap passes to form an attachment.

The present invention pertains to a method for exercising. The method comprises the steps of attaching a first weight portion 36 to a second weight portion 58. Then there is the step of strapping the first and second weight portions around the hips of a user so the first and second weight portions are situated over the right and left hips, respectively. Next there is the step of removing the first and second weight portions from the user. Then there is the step of separating the first and second weight portions. Next there is the step of strapping the first weight portion 56 to the right thigh of the user. Then there is the step of strapping the second weight portion 58 to the left thigh of the user.

Figure 7:
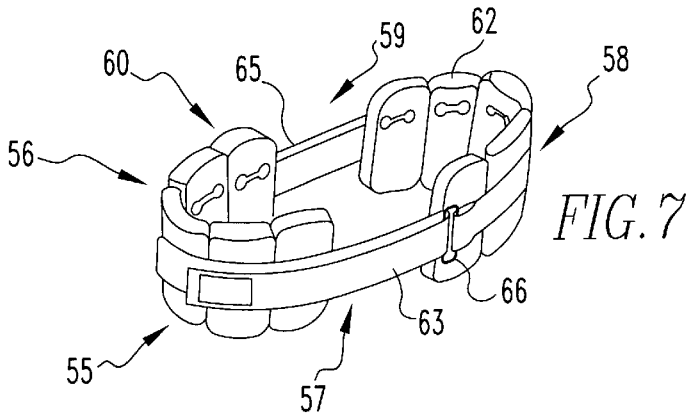
FIGS. 7, 8, 9, 10, 11 and 12 are schematic representations of a belt, arm, wrist, ankle, leg, thigh weight.
Figure 8:
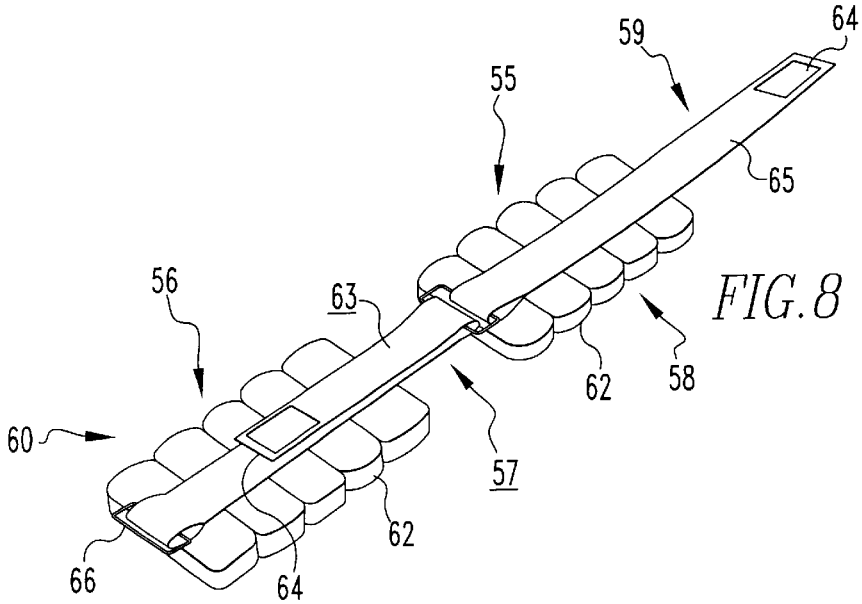
Figure 9:
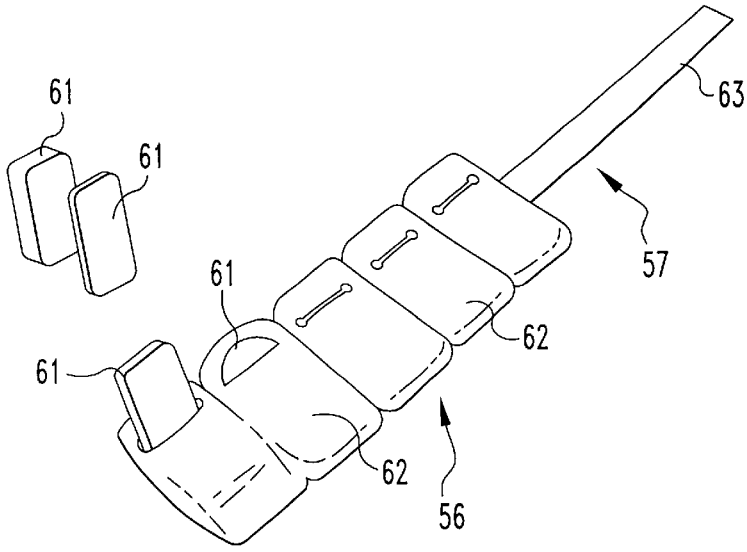

In the operation of the belt-angled-wrist-thigh system 55, a first weight portion 56 and second weight portion 58 are connected together through a first attachment portion 57 connected to the first weight portion of 56 and a second attachment to portion 58 connected to the second weight portion 58. See FIG. 7 and FIG. 8. Each attachment portion has pockets 62. The first attachment portion 57 includes a first strap 63 along which pockets 62 are sewn. The second attachment portion 59 includes a second strap 65 which also has pockets 62 sewn to it. The first weight portion 56 includes weights 61 that are inserted into the pockets 62 along the first strap 63, as shown in FIG. 9. Similarly, the second weight portion 58 includes weights 61 that are inserted into pockets 62 along second strap 65. The weight 61 can be chosen to be a certain weight so the overall weight of the respective weight portions is attained.

The first weight portion of 56 and second weight portion 58 are connected together by the first strap 63 passing through a loop 66 of the second attachment portion 59 and the first strap 63 then bring brought back upon itself and fixed to itself through hook and loop fasteners 64. The second strap 65 of the second attachment portion 59 is then brought around to pass through the loop 66 of the first attachment portion 57 and brought back upon itself to be fixed in place through hook and loop fasteners 64.

During positioning by a user onto the body, the first strap 63 is passed through loop 66 of the second attachment portion 59 and fastened back onto itself with the hook and loop fasteners 64. With the second strap 65 still loose, the first and second weight portions, which are now connected together and form a third weight portion 60 whose weight is the sum of the total weight of the first weight portion 56 and second weight portion 58, are positioned around the waist so the first weight portion 56 is situated about the right hip and the second weight portion 58 is situated about the left hip. Then the second strap 65 is passed through the loop 66 of the first attachment portion and fastened upon itself through hook and loop fasteners 64.

When the user decides to remove the weight system 55, the second strap 65 is separated from itself and pulled back through the loop 66 of the first weight portion 56. The first and second weight portions can then be removed from the body of the user.

Figure 10:
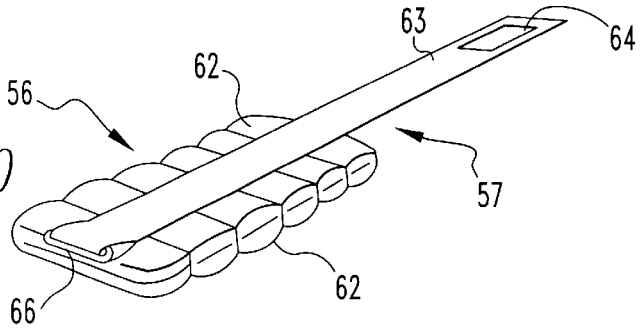
Figure 11:
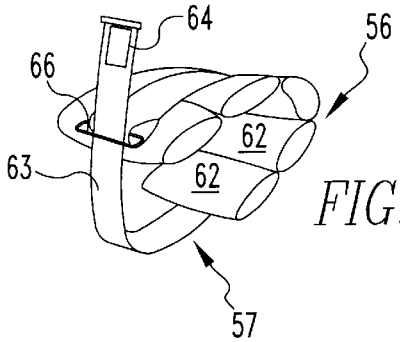
Figure 12:
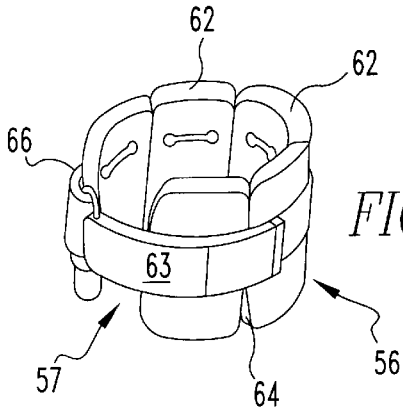

The user can then separate the first strap 63 from the loop of the second attachment portion 59 and thus separate the first weight portion 56 from the second weight portion 58. Each weight portion can then serve as a separate weight system that can be used to wrap around an ankle or wrist or thigh. See FIGS. 10, 11, and 12. In each case, the respective strap is simply passed through the loop 66 of its own attachment portion and pulled to create a desired tension around the given appendage of the user so it fits properly during exercise.

The present invention pertains to an exercise apparatus 70. The apparatus 70 comprises a weight 71. The apparatus 70 comprises a holder 72 for a weight 71. The holder 72 has a pocket 73 which holds the weight 71. The pocket 73 has a slot 74 through which the weight 71 is placed into or removed from the pocket 73. The pocket 73 has a smooth outer surface 75 with no protrusions or flap or zipper extending from the surface 75.

Figure 13:
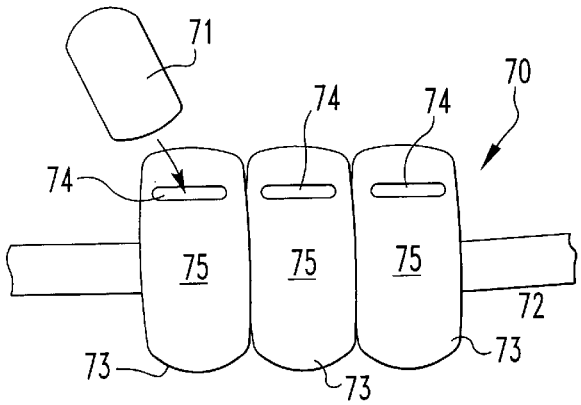
FIG. 13 is a schematic representation of a pocket with a weight.

In the operation of the exercise device 70, a continuous weight 71, is inserted into a pocket 73 through a slot 74 in the pocket 73. See FIG. 13. When the weight 71 is disposed in the pocket 73 it is fully surrounded by the pocket 73. The pocket 73 is sewn onto a holder 72. The slot 74 in the pocket 73 is flush with the outer surface 75 so the outer surface 75 is smooth and there are no flaps or zippers or hooks to extend from the outer surface 75 to rub or scratch the user. If the weight 71 is desired to be changed, the weight is simply removed through the slot 74 from the pockets 73 and a different weight 71 can be introduced back into the pocket 73.

The present invention pertains to a handweight. The handweight comprises a holder portion 81 which is adapted to fit about the hand and wrist of a user. The holder portion 81 holds a first weight 82 about the hand and a second weight 83 about the wrist. The first and second weights are adjustable. The handweight 80 comprises a first weight 82. The handweight 80 comprises a second weight 83.

Preferably, the holder portion 81 includes a first holder portion 84 disposed about the hand in which the first weight 82 can be changed and a second holder portion 85 disposed about the wrist in which the second weight 83 can be changed. The first holder portion 84 preferably is a first pocket 86 with a slot 87, and the second holder portion 85 is a second pocket 88 with a slot 87. The first weight 82 is inserted into or removed from the first pocket 86 through the slot 87. The second weight 83 is inserted into or removed from the second pocket 88 through the slot 87.

Preferably, the holder portion 81 includes a third pocket 89 disposed about the hand, and a fourth pocket 90 disposed about the wrist, and a third weight 91 which is removably installable in the third pocket 89 and a fourth weight 92 which is newly installed in the fourth pocket 90. The holder portion 81 is preferably one piece.

Preferably, the holder portion 81 has a first side 93 and a second side 94 and a first strap 95 and a second strap 96 on the first side 93. The first strap 95 and the second strap 96 connects with the second side 99 when the holder portion 81 is about the hand of the user. The first strap 95 and second strap 96 and second side 94 preferably have hook and loop fasteners 97 which mate to connect the first and second straps with the second side 94. Preferably, the holder portion 81 has an inner surface 98 which is smooth and has no seams. The first weight can be magnetic for medical applications.

The present invention pertains to a method for exercising. The method comprises the steps of placing a holder portion 81 about the hand and wrist of a user. Then there is the step of removing a first weight 82 from a first pocket 86 over the hand of the holder portion 81. Next there is the step of removing a second weight 83 from a second pocket 88 over the wrist of the holder portion 81. Then there is the step of inserting a new first weight 82 having a different weight than the first weight 82 into the first pocket 86. Next there is the step of inserting a new second weight 83 having a different weight then the second weight 83 into the second pocket 88.

Figure 14:
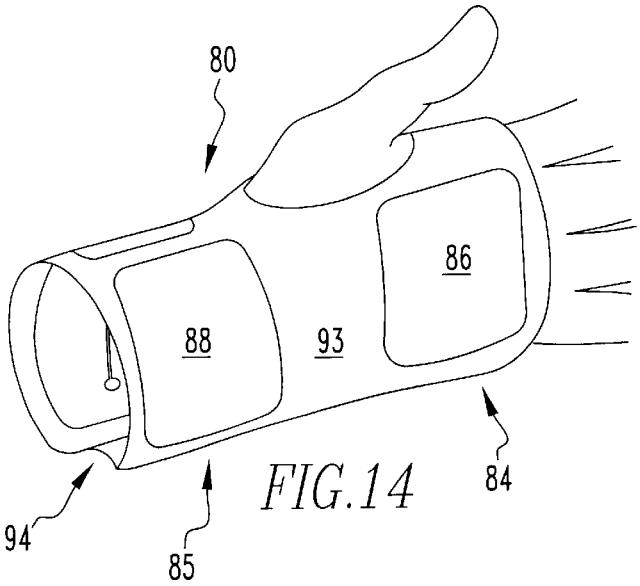
FIGS. 14, 15, 16, 17, 18, 19 and 20 are schematic representations of an adjustable hand-wrist weight of the present invention.

In the operation of the handweight 80, there is a holder portion 81 having a first holder portion 84 which holds a first weight 82, and a second holder portion 85 with holds a second weight 83, as shown in FIG. 14. The first holder portion 84 has a first pocket 86 with a slot 87, and the second holder portion 85 has a second pocket 88 with a slot 87. The first weight 82 is disposed in the first pocket 86 and is inserted into or removed from the first pocket 86 through the slot 87. Similarly, the second weight 83 is disposed in the second pocket 88 and is inserted into or removed from the second pocket 88 through the slot 87 in the second pocket 88. The first pocket 86 is disposed on the holder portion 81 so that it is positioned on the inside of the hand of a user. The second pocket 88 is disposed on the holder portion 81 so that it is positioned on the inside of the wrist of the user.

The first holder portion 84 also includes a third pocket 89 disposed on the holder portion 81 so that it is positioned on the outside of the hand, and the second holder portion 85 includes a fourth pocket 90 that is disposed on the holder portion of 81 so that it is positioned on the outside of the wrist. A third weight 91 is held by the third pocket 89 and a fourth weight 92 is held by the fourth pocket 90.

Figure 15:
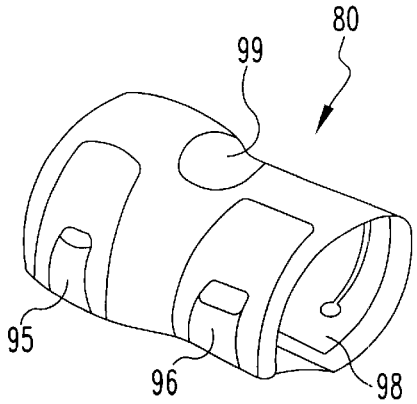
Figure 17:
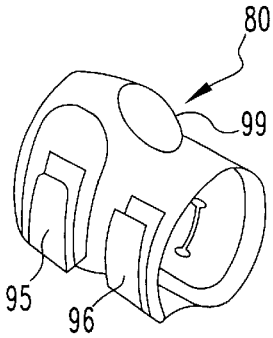

The holder portion 81 has a first side 93 and a second side 94 with a thumb hole 99 located approximately in the center of the holder portion 81. When the handweight 80 is put on to the hands of the user, the thumb of the hand extends through the thumb hole 99, the first side 93 is positioned on the inside of the hand and wrist and the second side 94 is positioned on the outside of the hand and wrist. There is a first strap 95 and a second strap 96 that are sewn to the first side 93 of the holder portion 81. At the ends of the first strap 95 and second strap 96 are hook and loop fasteners 97 which mate with hook and loop fasteners 97 on the second side 94 of the holder portion 81. The straps and hook and loop fasteners 97 serve to connect and maintain tension of the holder portion 81 about the hand and the wrist. See FIGS. 15 and 16.

The pockets allow for the easy introduction and removal of weights so desired weights can be used with the handweight at any given time. The weights are located around the wrist and the hand to provide resistance to both areas for exercise purposes.

Figure 16:
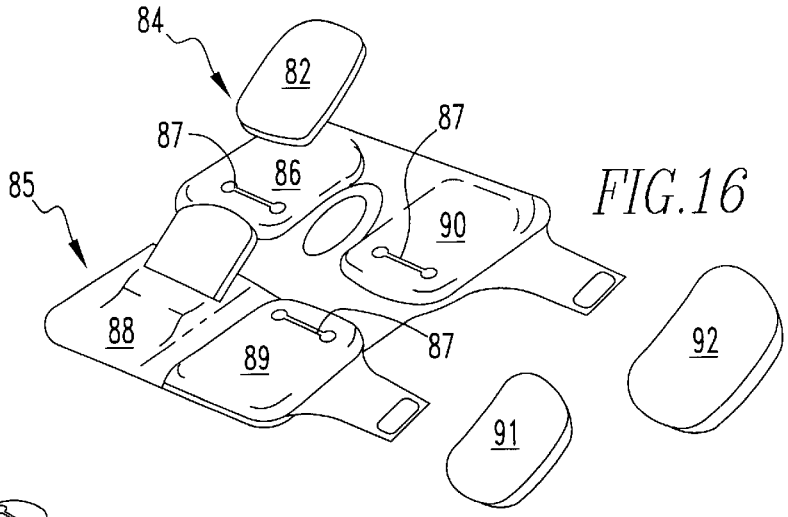
Figure 18:
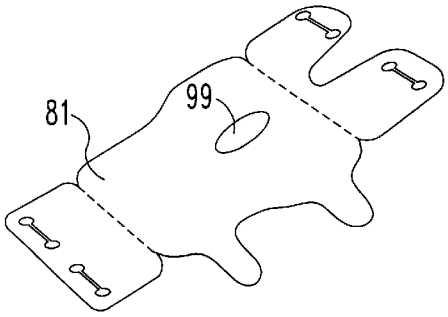
Figure 19:
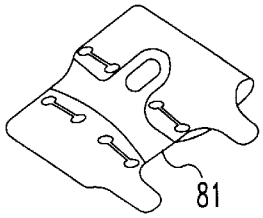
Figure 20:
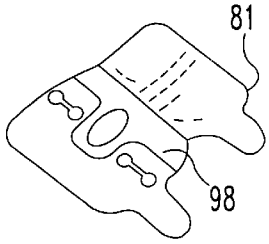

As shown an FIG. 18, the holder portion 81 is one continuous piece with the pockets formed into it. During manufacture, the pockets are folded inwards about the shown dotted lines in FIG. 18 and the weights are inserted into or removed from the respective pockets as shown in FIG. 16. The holder portion 81 is sewn together at the zig zag points shown in FIG. 19. Once the sewing is complete, the holder portion 81 is turned inside out, as shown in a FIG. 20 so the inner surface 98 that is in contact with the hand and wrist of the user is smooth without any seams or edges to irritate our cause a blister to a user during exercise with the handweight 80.

The presence of the first pocket 86 on the inside of the hand when the holder portion 81 is in place, allows a squeezable or pliable weight to the inserted into the first pocket 86. This not only provides weights to the hand for exercise purposes but also serves to hold the weight 82 so the user can squeeze the weight 82 an exercise the fingers and tendons and muscles associated with the gripping action of the hand.

Alternatively, the first weight 82, second weight 83, third weight 91 and fourth weight 92, either all or any one of them, can be magnetic to use in medical applications. See for instance page 323 of Natural Healing Basics, and the chapter titled "Magnets: Stop Pain . . . Ease Arthritis . . . Help Heal Broken Bones and More", incorporated by reference, herein. The presence of the magnet causes the blood to be drawn to the area in the hand about the magnet to increase blood flow and diminish pain due to a combination of the Hall effect and stabilizing influence on the nervous system. Typically, the medical magnet is rated at 200 to 800 gauss.

The present invention pertains to a handweight 110. The handweight 110 comprises a holder portion 112 which fits about the hand and has a plurality of pockets 114. Each pocket 114 has a slot 116. The pockets 114 are adapted to be disposed about the knuckles of a user. The handweight 110 comprises a plurality of weights 118 which are removably disposed in respective pockets 114. Each weight 118 is inserted in and removed from the pocket 114 through respective slots 116 in the pockets 114.

Figure 21:
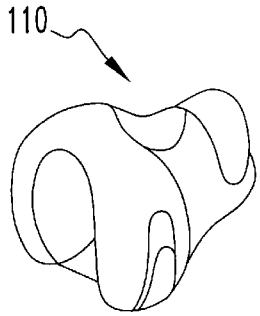
FIGS. 21, 22, 23, 24, 25 and 26 are schematic representations of another embodiment of a handweight of the present invention.
Figure 22:
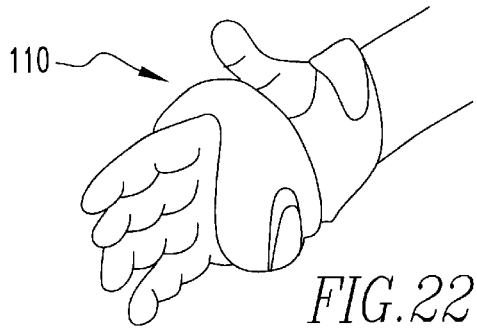

In the operation of handweight 110, as is shown in FIGS. 21 and 22, there is a one-piece holder portion 112 that has a pocket 114. The pocket 114 inside the holder portion 112 is accessed through a slot 116 through which a one piece weight 118 is inserted or removed. The holder portion 112 has straps 120 and a thumb opening 122 which allows the holder portion 112 to be placed about the hand. The weight 118 is flexible so that it can bend around the hand when the handweight 110 is connected to the hand by the straps being connected together through hook and loop fasteners.

Figure 23:
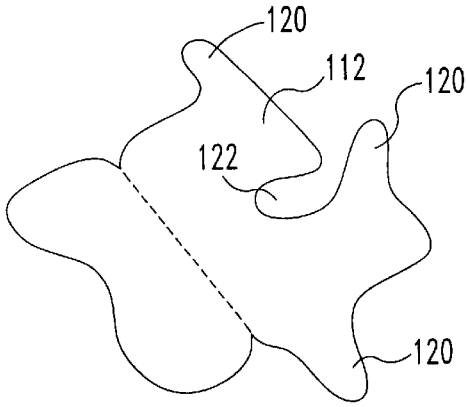
Figure 24:
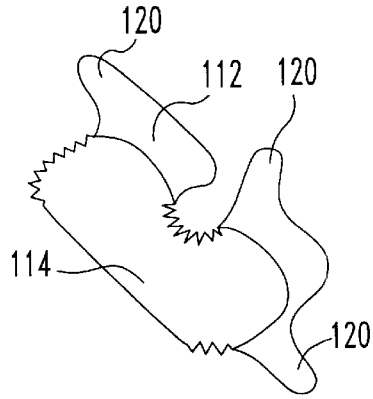
Figure 25:
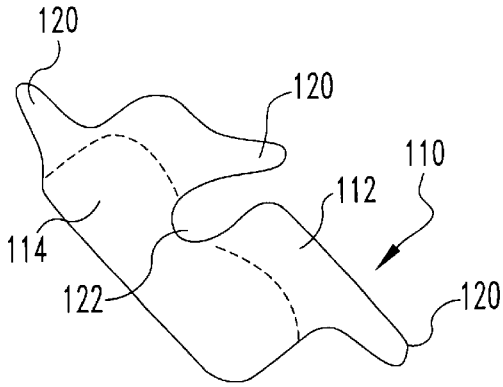
Figure 26:
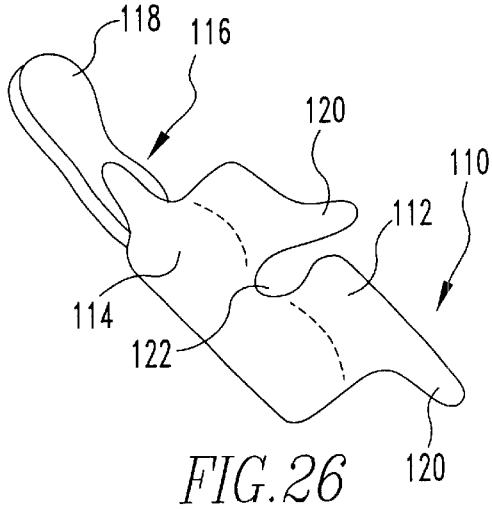

The holder portion 112 is formed by first folding the holder portion 112 along the dotted line in FIG. 23. Then, the holder portion 112 is sewn along the zig zag lines shown in FIG. 24 to form the pockets 114. The holder portion 112 is then turned inside out, as shown in the FIG. 25. This allows the smooth outer surface of the holder portion 112 to contact the hand of the user to minimize blistering or irritation of the skin of the user. Then, the weight 118 is inserted through the slot 116 into the pocket 114. If it is desired to change the weight 118, then the weight of 118 is removed from the pocket 114 through the slot 116 and a new and different weight 118 is inserted back into the pocket 114 through the slot 116. To facilitate the weight being inserted or removed from the pocket 114, the weight 118 is covered with a Lycra or Tricot fabric so the weight will slide in or out of the pocket easily. Generally, this is done with all weights and pockets.

The present invention pertains to a handweight 140. The handweight 140 comprises a one-piece holder portion 142 with a pocket 144. The handweight 140 comprises a one-piece continuous foldable weight 146 which is disposed in the holder portion 142 and extends about the hand of a user when the handweight 140 is on the hand of the user.

Figure 27:
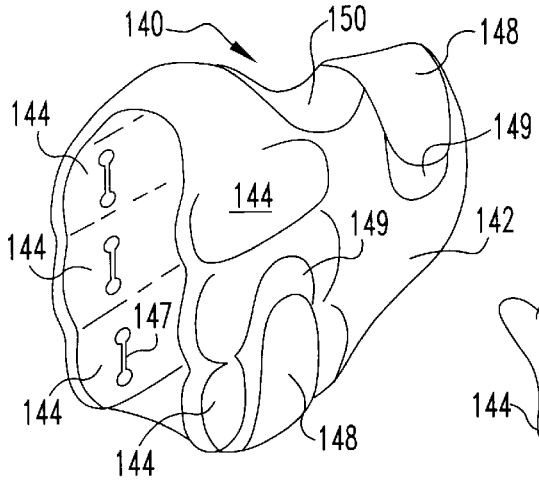
FIGS. 27 and 28 are schematic representations of a knuckle weight of the present invention.
Figure 28:
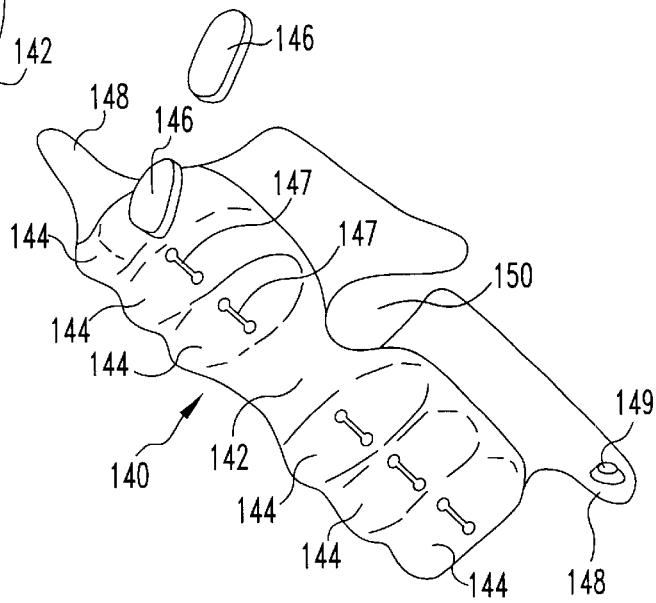

In the operation of the handweight 140, shown in FIGS. 27 and 28, there is a one piece holder 142 that has pockets 144. Each pocket 144 has a weight 146 in it. The weight 146 is inserted into or removed from the pockets through a slot 147. The holder 142 is configured so that when it is around the hands of the user, the weights 146 in the pockets 144 are aligned over the knuckles of the back of the hand of the user and also in front of the hand and below the fingers.

The handweight 140 has straps 148 with hook and loop fasteners 149 on them. On the corresponding symmetrically opposite location the one piece holder 142 are also hook and loop fasteners which mate with the corresponding hook and loop fasteners on the straps 148 to tension and hold the handweight 140 in place around the hands. There is a thumb opening 150 in which the thumb is discloses when the handweight 140 is in place.

The present invention pertains to an exercise apparatus 160. The exercise apparatus 160 comprises a vest 162 adapted to fit about the chest and back of a user. The vest has pockets 164 which hold weights 166. The exercise apparatus 160 comprises an adjustable fitting mechanism 168 which can tighten the vest 162 about the user from the right and left sides of the user.

Preferably, the pockets 164 are disposed on the inner surface 170 of the vest 162. The weights 166 preferably can be changed to vary the total weight of the vest 166. Preferably, the vest 162 has a back 172 and a front 174 with a right side 176 and left side 178, and the vest 162 has a zipper 180 which connects the right side 176 and left side 178 together.

The fixing mechanism 168 preferably includes a first loop and strap mechanism 182 connected to the right side 176 and the back 172, and a second loop and strap mechanism 184 connected to the left side 178 and the back 172. Each loop and strap mechanism is adjustable to vary the tension of the vest 162 about the user.

Figure 29:
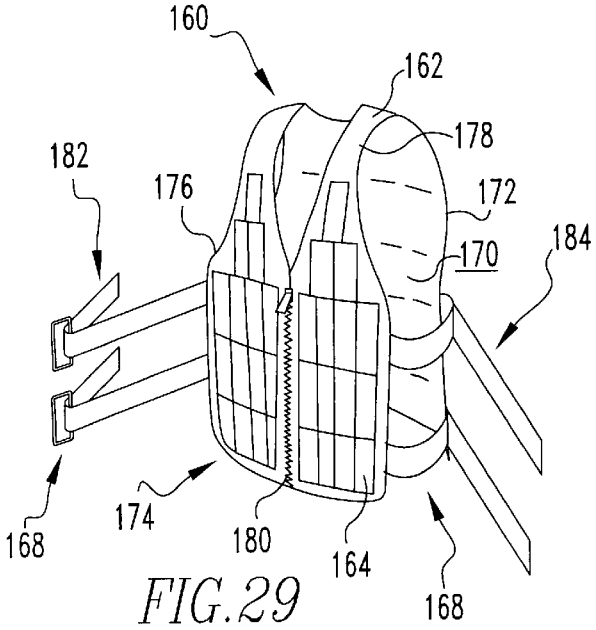
Figure 33:
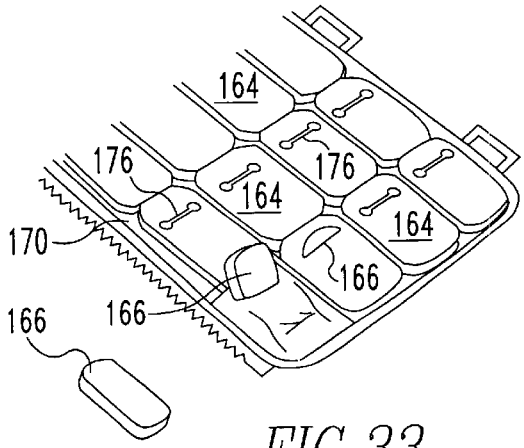

In the operation of the exercise apparatus 160, shown in FIG. 29, there is a vest 162 having a front 174 and a back 172. The vest 162 has pockets 164 that are on the back 172 and the right side of 176 and the left side 178 of the front 174. The vest covers the chest and back of the user and can be worn under clothing or during sports activity such as basketball or soccer besides the more standard jogging or walking exercises as well as aerobic exercise. Each pocket 164 has a weight 166 disposed in them. Each pocket 164 has a slot 186 through which a weight 166 is inserted or removed. The pockets 164 or disposed on the inner surface 170 of the vest 162. See FIG. 33.

The right side 176 and left side 178 of the front 174 have a zipper mechanism 180 connected to them which allows the right side 176 and left side 178 to be zipped together when in place around the body of the user. There is a first loop and strap mechanism 182 connected to the right side 176 and the back 172, and a second loop and strap mechanism 184 connected to the left side 178 and back 172. The first and second loop and strap mechanisms are used to tension the vest about the user when the vest is place. The first and second loop and strap mechanisms allow the vest to be tightened from both the right and left sides of the user so the vest tensions uniformly about the user. See FIGS. 31 and 32.

Figure 30:
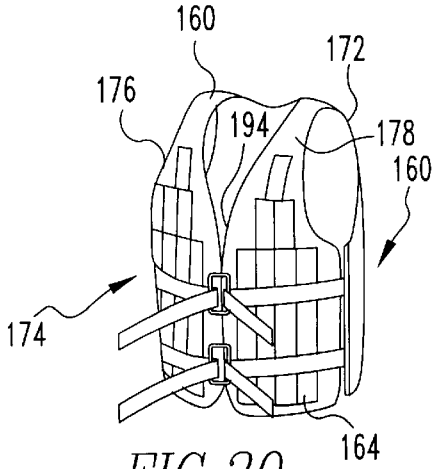

Instead of a zipper used to connect the right side 176 and left side 78, there can be fasteners 194 on the right side 176 and left site 178 which are used to connect the right side 176 and left side 178 together, as shown in FIG. 30.

Figure 31:
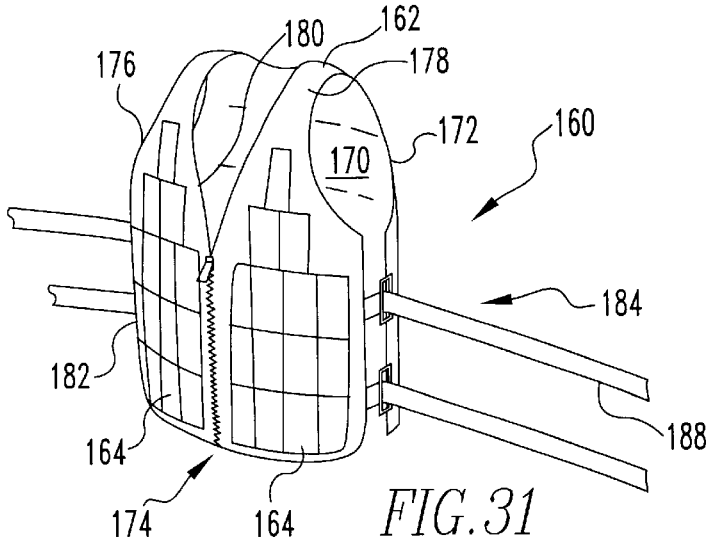
Figure 32:
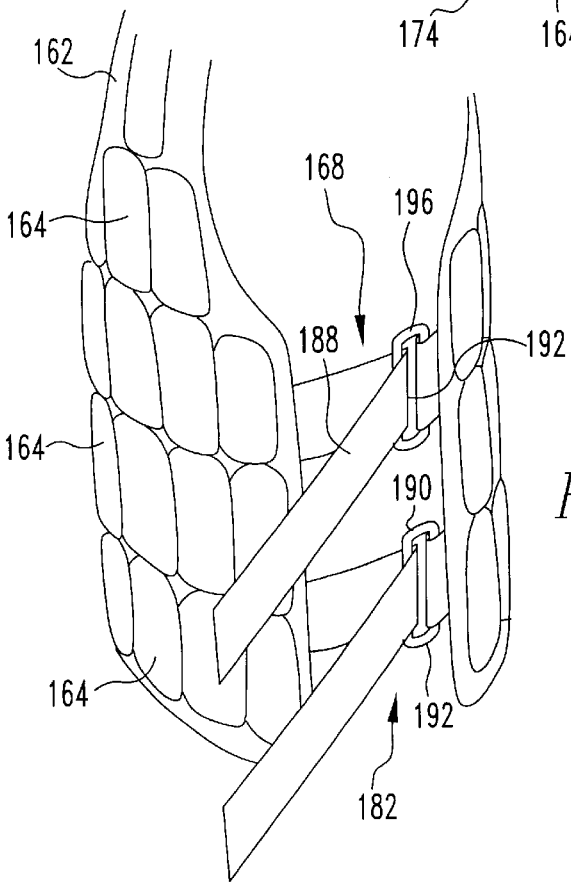

Each loop and strap mechanism 182 has a strap 188 and a loop 190 through which a strap 188 passes, as shown and FIGS. 29 and 31. After the strap 188 passes through the loop 190, it is passed through a second loop 192 adjacent the first loop 190 in the direction from which it came. Each of the straps of the loop and strap mechanisms are then pulled forward causing the right side 176 and left side 178 and back 172 to come together to the desired tension.

The weights 166 are about 0.5 inches thick to 1 inch thick and are 0.5 pounds to 1 pound, respectively, in weight. They are two inches wide and 4 inches high. The thickness of the fabric is 0.0625, and is made of a Wearnyle teflon coated nylon.

These weights can be used in all embodiments described above with pockets. In regard to the handweight covering the knuckles, the weights can be longer and narrower but of the same thickness. The weight can be as little as 0.25 pounds. For the weights in cells such as the ankle and wrist weights, the weight itself can be between 0.5 pounds to 7 pounds each. Generally, the holder portions are made of nylon covered in Neoprene made by Rubatex that is ⅛ inches thick.

Materials for the weights and holder portions or cells are also described in U.S. patent application Ser. No. 08/555,771, filed Nov. 9, 1995, titled "Reinforced Thermoplastic Elastomeric Gel"; U.S. patent application Ser. No. 08/694,993 filed Aug. 9, 1996, titled "High Friction Interface for Weights"; U.S. patent application Ser. No. 08/619,330 filed Mar. 21, 1996, titled "Exercise and Therapy Device"; and U.S. patent application Ser. No. 08/555,772 filed Nov. 9, 1995, titled "Concealable Arm and Leg Weight", all of which are incorporated by reference herein. Each weight has a durometer preferably less than 50 shore A and is a composite comprising reinforcement of solid particles of ceramic or metal greater than or equal to 1 micron in size; and a thermoplastic elastomer having polymer chains, said reinforcement is distributed throughout and between the polymer chains.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An exercise apparatus comprising:

a plurality of weights, each weight being made of a reinforced thermoplastic elastomer gel composite comprising:

reinforcement of solid particles of ceramic or metal greater than or equal to one micron in size; and a thermoplastic elastomer having polymer chains, said reinforcement being distributed thoughout and between said polymer chains, the composite having a durometer less than 50 shore A;

a vest adapted to fit about the chest and back of a user, said vest having pockets which hold the weights; and an adjustable fitting mechanism which can tighten the vest about the user form the right and left sides of the user.

2. An apparatus as described in claim 1 wherein each weight weighs between 0.5 lbs. and 1 lb., and is between 0.5 in. thick and 1 in. thick.

3. An apparatus as described in claim 2 wherein the pockets each have a slot through which the weights are inserted or removed.

4. An apparatus as described in claim 3 wherein each weight is 2 in. wide and 4 in. high.

5. An apparatus as described in claim 4 wherein the pockets are disposed on the inner surface of the vest.

6. An apparatus as described in claim 5 wherein the weights can be changed to vary the total weight of the vest.

7. An apparatus as described in claim 6 wherein the vest has a back and a front with a right side and left side, and the vest has a zipper which connects the right side and left side together.

8. An apparatus as described in claim 7 wherein the fitting mechanism includes a first loop and strap mechanism connected to the right side and the back, and a second loop and strap mechanism connected to the left side and the back, each loop and strap mechanism adjustable to vary the tension of the vest about the user.

* * * * *